US005160305A

United States Patent [19]

Lin

[11] Patent Number: 5,160,305

[45] Date of Patent: Nov. 3, 1992

[54] MULTIFUNCTIONAL GYM EXERCISER WITH ADJUSTMENT TABLE

[76] Inventor: Paul Lin, Tao Yuau, Taiwan, 312

[21] Appl. No.: 748,506

[22] Filed: Aug. 22, 1991

[51] Int. Cl.[5] ..... A63B 21/00

[52] U.S. Cl. ..... 482/138; 482/57; 482/142

[58] Field of Search ..... 482/54, 100–103, 482/118–119, 133, 136–138, 140, 142, 57, 60

[56] References Cited

U.S. PATENT DOCUMENTS

| | | | |
|---|---|---|---|
| 2,855,199 | 10/1958 | Noland et al. | 482/137 X |
| 3,127,171 | 3/1964 | Noland et al. | 482/137 X |
| 4,369,966 | 1/1983 | Silberman et al. | 482/140 X |
| 4,509,746 | 4/1985 | Mask | 482/142 X |
| 4,635,934 | 1/1987 | Roethke | 482/142 X |
| 4,700,946 | 10/1987 | Breunig | 482/137 |
| 4,705,267 | 11/1987 | Jackson | 482/138 |
| 4,746,114 | 5/1988 | Grider | 482/142 X |
| 4,763,897 | 8/1988 | Yakata | 482/100 |
| 4,792,135 | 12/1988 | Chin-Sen | 482/138 |
| 4,826,157 | 5/1989 | Fitzpatrick | 482/103 |
| 4,828,255 | 5/1989 | Lahman | 482/142 |
| 4,832,336 | 5/1989 | Lahman | 482/142 |
| 4,871,166 | 10/1989 | Sterba et al. | 482/142 |
| 4,880,227 | 11/1989 | Sowell | 482/138 X |
| 4,915,377 | 4/1990 | Malnke et al. | 482/138 X |
| 4,919,419 | 4/1990 | Houston | 482/142 X |
| 4,932,654 | 6/1990 | Batca | 482/142 X |
| 4,974,840 | 12/1990 | Welch | 482/137 X |
| 4,976,426 | 12/1990 | Szabo | 482/137 X |
| 4,979,734 | 12/1990 | Sims | 482/137 X |
| 4,979,736 | 12/1990 | Maynard | 482/137 X |
| 5,018,727 | 5/1991 | Cornell | 482/142 X |
| 5,050,589 | 9/1991 | Engle | 482/142 X |
| 5,058,888 | 10/1991 | Walker et al. | 482/142 X |
| 5,069,447 | 12/1991 | Snyderman et al. | 482/142 X |

FOREIGN PATENT DOCUMENTS

| | | | |
|---|---|---|---|
| 0379274 | 7/1990 | European Pat. Off. | 482/142 |

*Primary Examiner*—Robert Bahr
*Attorney, Agent, or Firm*—Bacon & Thomas

[57] ABSTRACT

A multifunctional gym exerciser with an adjustable table having a semicircular set plate on a front edge of the main body of the multifunctional exerciser and a plurality of set holes on the circumference of the set plate, so that, by utilizing a combination of a set bolt with the set plate, a user can optionally secure various exercise attachments, such as a pedal assembly, a leg lift assembly and a sit up support according to different exercise requirements. Furthermore, through the use of a movable supporting stand located at the bottom edge of the main body, the table position can be widely adjusted, and a seat and rest seat can also be adjusted to a desired slope in order to achieve the best exercise effect.

7 Claims, 6 Drawing Sheets

MULTIFUNCTIONAL GYM EXERCISER WITH ADJUSTMENT TABLE

BACKGROUND AND SUMMARY OF THE INVENTION

The present invention is related to an improvement of a multifunctional gym exerciser with a table adjustment, characterized in that a semicircular set plate is provided on the front edge of its main body, and a plurality of set holes are provided on the circumference of the said set plate, so that after simple combination of a set bolt with the said set plate, one can optionally replace the desired pedal assembly, leg left assembly and sit up support according to the different exercise requirements, and by means of the replacements of the movable supporting stand located at the bottom edge of the main body, the table position can be widely adjusted, and the seat and rest seat can also be adjusted with proper slope in order to achieve the best exercise effect.

It is well known that a conventional gym exerciser (refer to FIG. 4) consists mainly of a main body 1 and a sit up table 2. The main body 1 is in a T-shape and the sit up table 2 is firmly arranged on one end of the said main body 1, and two sit up supports 11, 12 are arranged on the bottom and the top edge of the other end of the said main body 1, while its upper edge is connected with a movable sit up support 12. The user can lie upside down on the table 2, put his knee joints astride on the said sit up support 12 and hold his legs on the said sit up support 11, and carry out the sit up movements. Since such kind of gym exerciser is a stationary type, thus it can not replace other kinds of sporting goods. Therefore, it possesses only one sit up movement function and is not practical to those consumers who want to make multiple exercises with a gym exerciser.

In view of the said problem, the present invention is thus created which consists mainly of a main body, a base, a table and a movable support, whereby on both sides of the main body and table a plurality of set holes are provided respectively, and a semicircular set plate is arranged on the front edge of its main body and a plurality of limiting holes are provided on the circumference of the said set plate, and the said table consists of a seat and a rest seat, a supporting stand is provided at the bottom edge of the said table, one end is connected with the main body by means of a channel iron and a bolt, while another end is fixed at the other end of the said main body by means of a supporting stand, at the bottom edge of another end of the said main body is connected with a movable support through a channel iron, wherein the said movable support is connected with the other end of the base by means of the double channel iron on the other end.

Therefore, the main object of the present invention is to provide a multifunctional gym exerciser with optional table adjustment, so that after simple combination of a set bolt with the said set plate, one can optionally replace the desired pedal assembly, leg left assembly and sit up support according to the different exercise requirements, in order to achieve the effect of simple replacement function of a gym exerciser.

Another object of the present invention is to provide a multifunctional gym exerciser with optional table adjustment, so that by means of the replacements of the movable supporting stand located at the bottom edge of the main body, the table position can be widely up and down adjusted, and the seat and rest seat can also be adjusted with proper slope in order to meet the different movement gestures requirements of the user.

DETAILED DESCRIPTION OF THE PREFERRED EMBODIMENTS

The above-described and other objects, features and advantages of the present invention will be more apparent from the following description quoted on the basis of annexed drawing as following. The preferred embodiment drawing is to explain the present invention and to be understood not the limitation of the present invention.

Figure 1:
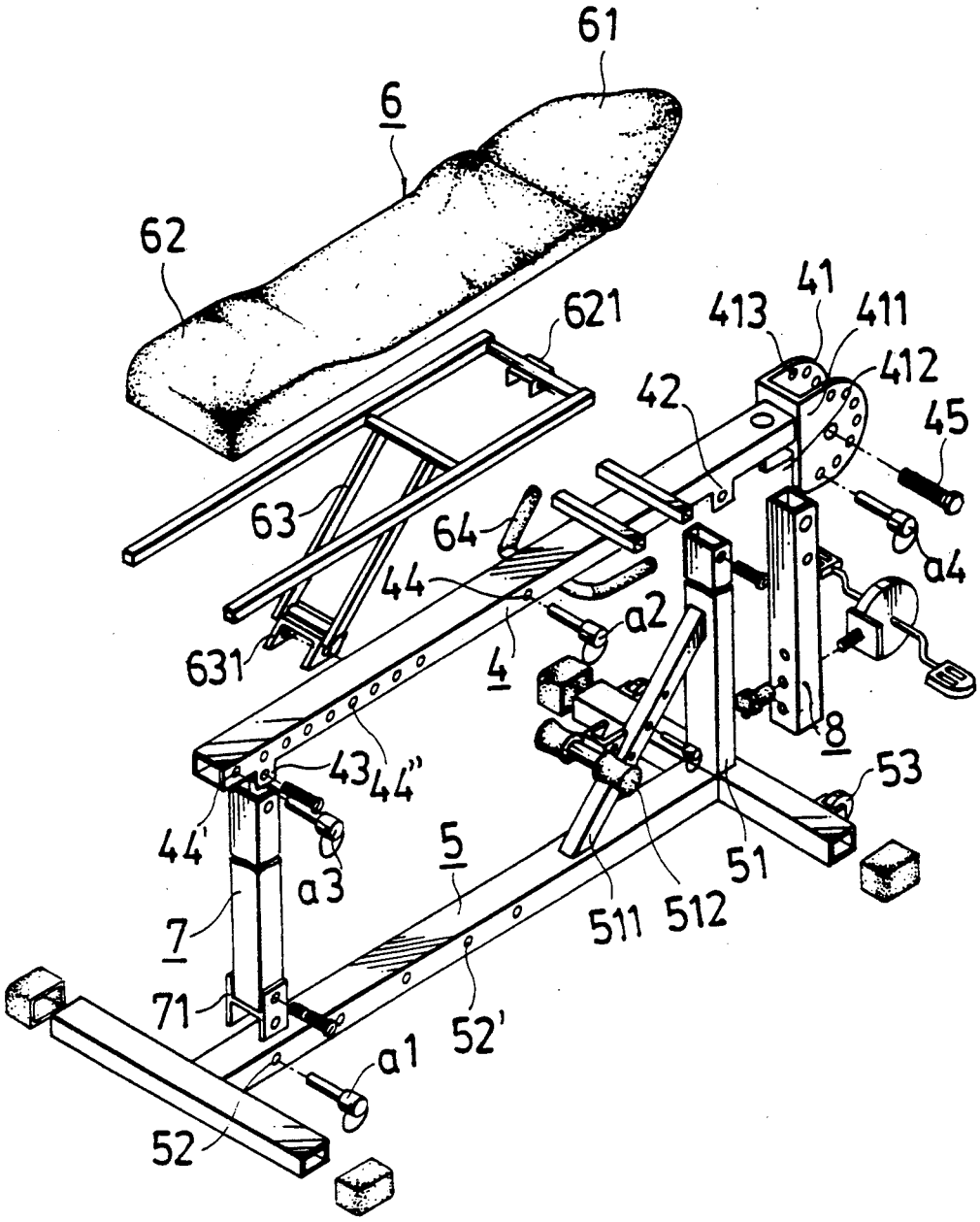
Figure 2:
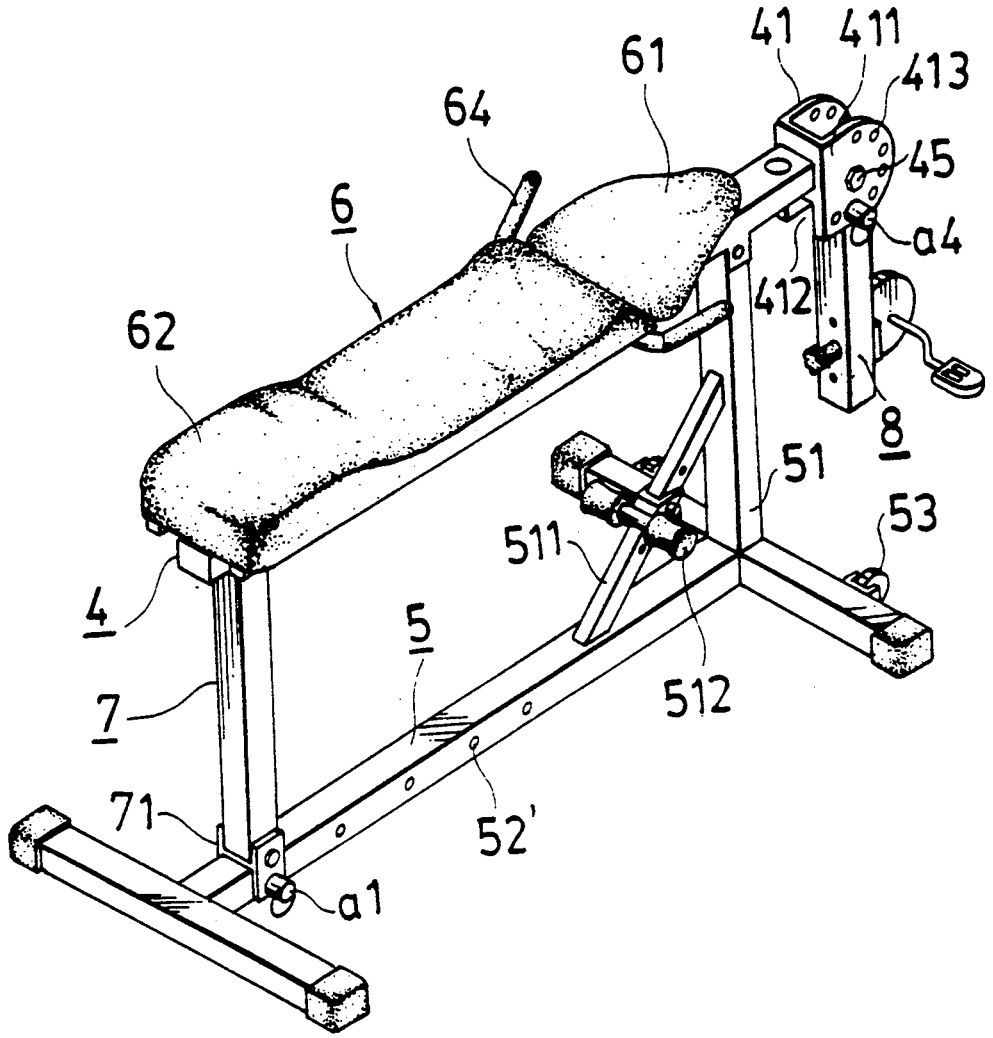
Figures 1, 2:
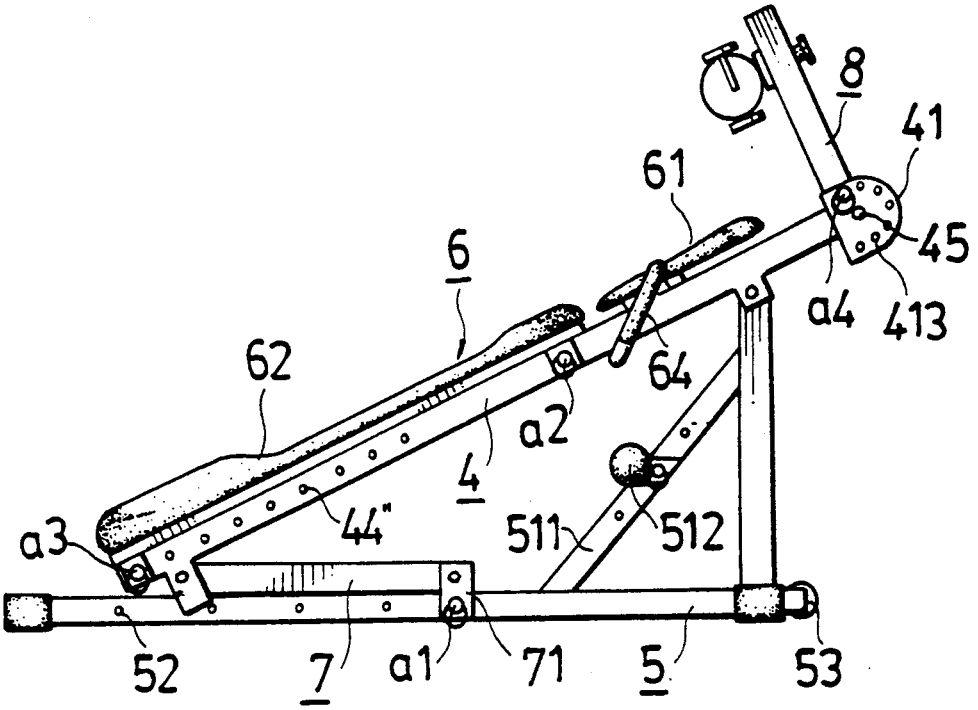
Figure 2:
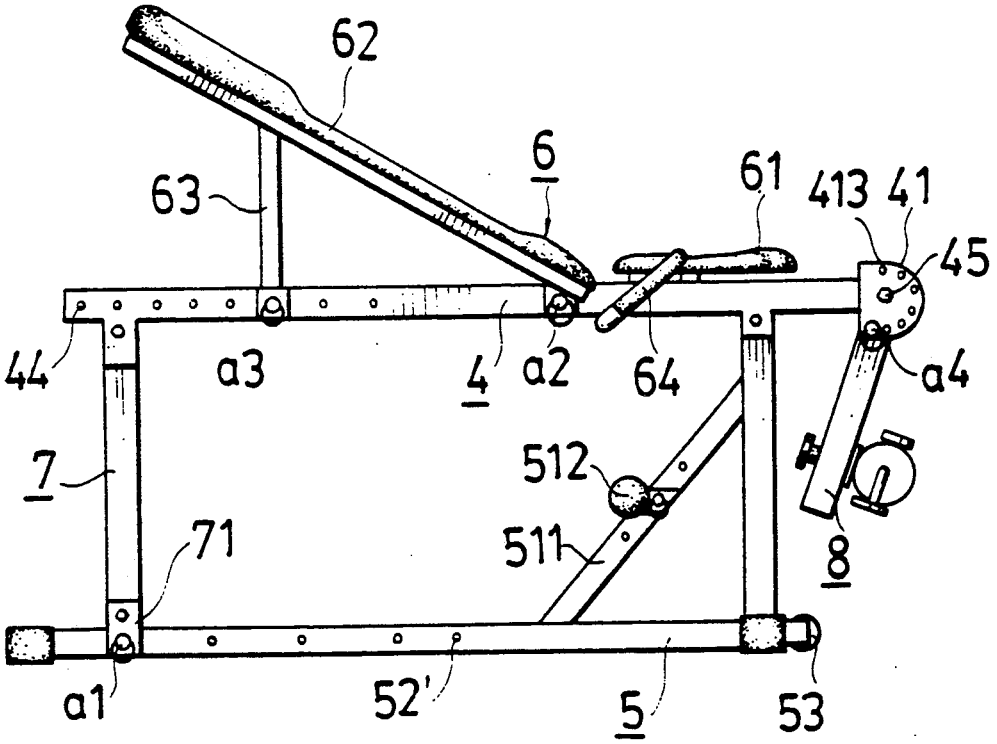
Figure 3:
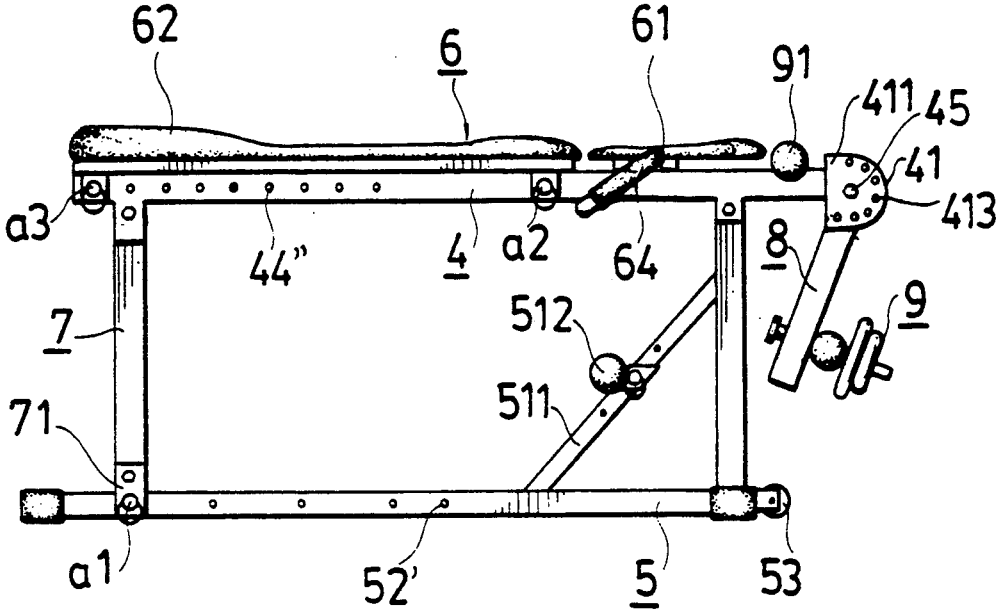
Figures 1, 3:
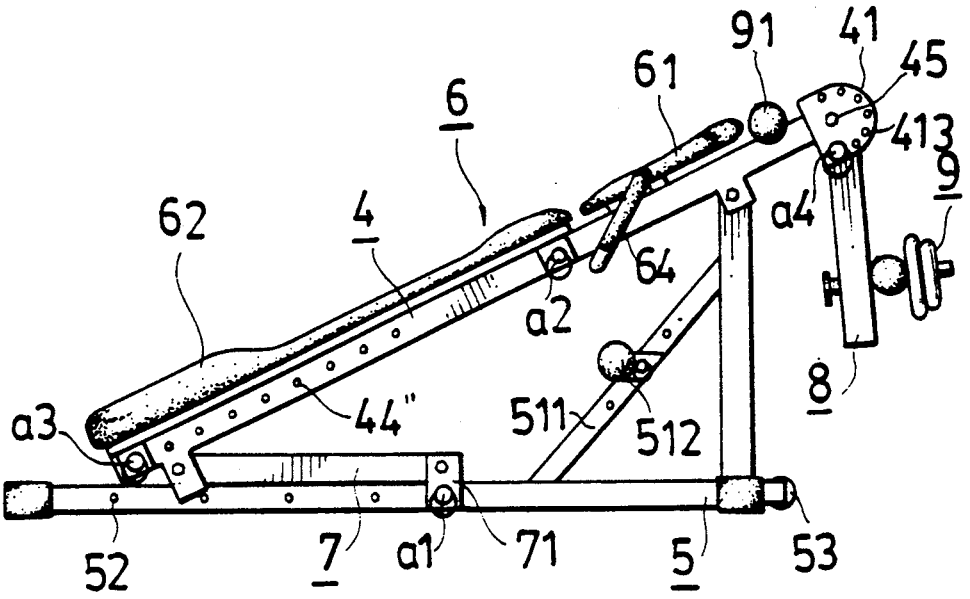
Figures 2, 3:
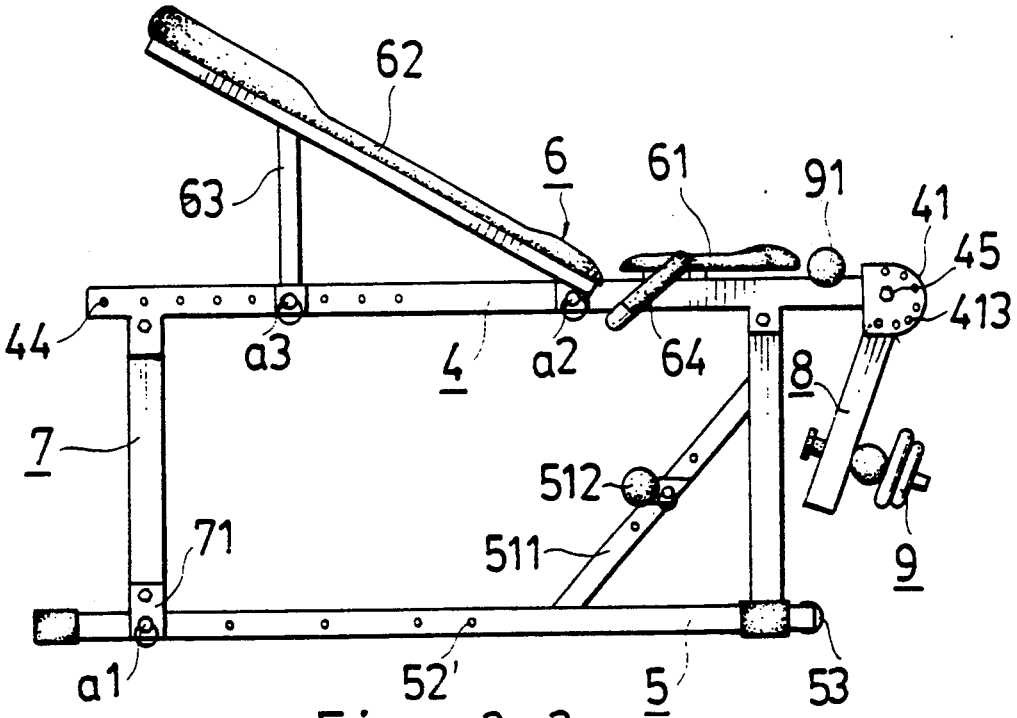

FIG. 1 an explosive view of a gym exerciser of the present invention;

FIG. 2 a pictorial view of a completed gym exerciser of the present invention, showing an example of a preferred embodiment used with a pedal assembly attachment;

FIG. 2-1 an another example of a preferred embodiment of an invented gym exerciser used with a pedal assembly attachment showing its table position is widely adjusted through a movable support;

FIG. 2-2 an another example of a preferred embodiment of an invented gym exerciser used with the pedal assembly attachment showing its rest seat is adjusted to a proper slope through the replacement of a supporting stand;

FIG. 3 an example of a preferred embodiment of an invented gym exerciser showing a sit up support attachment provided at the front edge of its main body;

FIG. 3-1 an another example of a preferred embodiment of an invented gym exerciser provided with a leg lift assembly;

FIG. 3-2 a further example of a preferred embodiment of an invented gym exerciser provided with a leg lift assembly.

Figure 4:
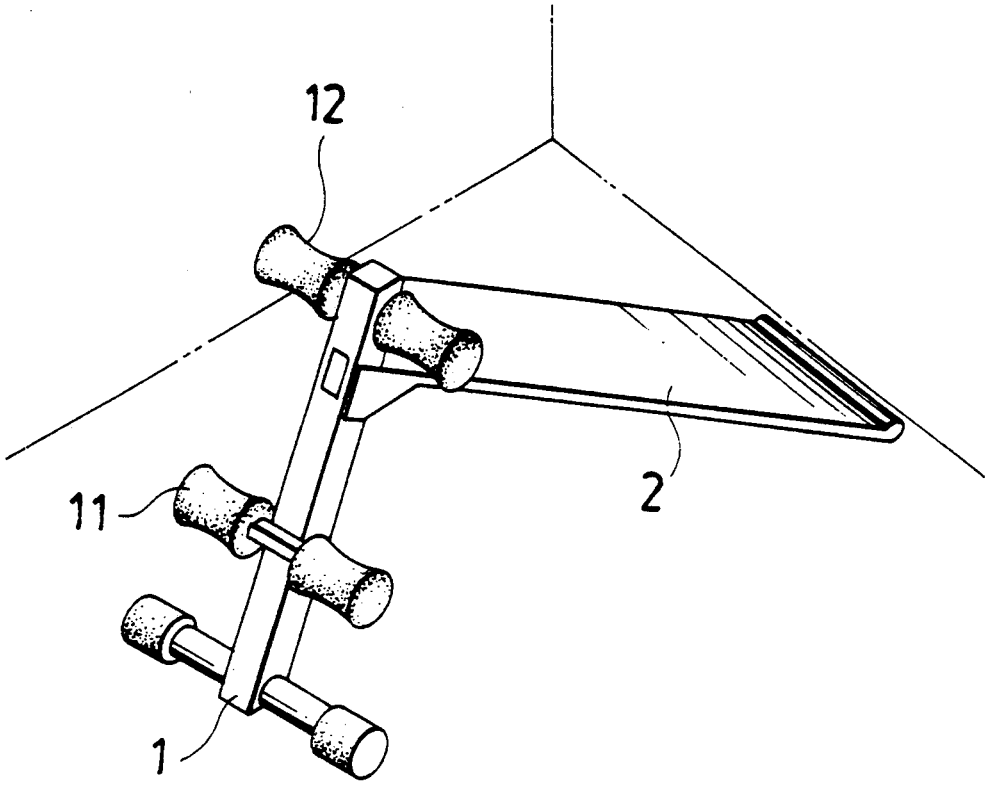

FIG. 4 a perspective view of a conventional gym exerciser.

Referring to FIG. 1, one can clearly see that the present invention of a multifunctional gym exerciser with an adjustable table comprises of a main body 4, a base 5, a table 6 and a movable support 7. A semicircular set plate 41 is provided at the front edge of the main body 4 and each a channel iron 42, 43 is provided respectively at its bottom sides, and a plurality of set holes 44 are arranged at its both sides, and at the joint between the set plate 41 and the main body 4 an expansion field 411 and a hole 412 are provided, on its circumference has a limiting hole 413 and at the upper part of an end of the base 5 a supporting stand 51 is provided, and at both of the sides of the base 5 a plurality of set holes 52 are provided. The table 6 consists of a seat 61 and a rest seat 62, and at one end of the bottom of the rest seat 62 a channel iron 621 is provided and at its center is connected with one end of a supporting stand 63, while a channel iron 631 is provided at the other end of the said supporting stand 63; at the bottom of the seat 61 a slope force rod 64 is provided. While combination, first of all screw the channel iron 42 at one end of the main body 4 on the supporting stand 51 which is located at one end of the base, and then screw the channel iron 43 at another end of the main body 4 with one end of the movable support 7, and the other end of the said movable support 7 is connected with the other end of the base 5 by means of the double channel iron 71, a set bolt a1 and the set hole 52, then put the table 6 on the top of the main body 4, make sure the channel iron 621 located under the rest seat 62 is engaged with the main body 4, then use a set bolt a2 to fix the table 6 with the main body 4 together through the set hole 44 located at the sides of the main body 4; then connect the supporting stand 63 located under the table 6 through a channel iron 631 with the other end of the main body 4, then use a set bolt a3 to fix the main body 4 through the set hole 44', in such case, the said supporting stand 63 lies flat under the rest seat 62. Finally insert a pedal assembly 8 is inserted into the said set plate 41 and fixed with the said set plate 41 by means of a set bolt 45 to complete the invented gym exerciser (see FIG. 2). The user can sit on the seat 61, rotate the pedal assembly 8 with his legs and hold the force rod 64 with his hands. Since there are expansion field 411 and hole 412 between the joint of the set plate 41 and the main body 4, therefore, the pedal assembly 8 can make greater magnitude of oscillation inside the said set plate 41.

The invented gym exerciser may achieve different exercise effect by adjusting the table 6 and the pedal assembly 8 (see FIG. 2-1). Take out the set bolt a1 from the movable stand 7 and the base 5 and then replace the double channel iron 71 to the set hole 52' adjacent to the supporting stand 51 of one end of the base 5, then use the set bolt a1 to fix the double channel iron 71 and the base 5, so that the movable support 7 lies flat on the top of the base 5 and the table 6 has a proper slope downwards; push the pedal assembly 8 to the top of the set plate 41, screw the set bolt a4 into the limiting hole 411 of the set plate 41, so that the pedal assembly 8 is limited at the top of the set plate 41. The user can lie on the table 6 upside down and tread the pedal the pedal assembly 8 with his legs and holds the force rod 64 with his hands to make much more movements. If the user wants to have more freely movement of the pedal assembly 8, he can restore the treadmill 8 to its original down falling status, unscrew the set bolt a1 from the double channel iron 71 and move to the set hole 52 at the other end of base 5 and fix the set bolt a1, so that the movable support 7 and the main body 4 is connected vertically again, then unscrew the set bolt a3 from the channel iron 631 located at the other end of the supporting stand 63 and adjust the said channel iron 631 to the front end of the main body 4, so that the rest seat 62 is supported by one end of the supporting stand 63 to form a slope upwards; finally insert the set bolt a3 into the channel iron 631 and fix at the set hole 44'' of the main body 4 (see FIG. 2-2); the user can sloppily lie on the rest seat 62 to pedal the pedal assembly with force saving By means of the simple combination of the set plate 41 and the set bolt 45, the user can also replace a leg lift attachment 9 in stead of a pedal assembly 8 on the invented gym exerciser (see FIG. 3). First of all arrange a sit up support 91 between the seat 61 and the set plate 41, then insert the upper part of a leg lift attachment 9, into the said set plate 41, after fixing the set plate 41 and the leg lift attachment 9 with the set bolt 45, the user can sit on the seat 61, lay the knee joints astride on the sit up support 91, holds the force rod 64 with his hands and holds the leg lift attachment 9 with the back of his feet. When carrying out the leg lift movement, one can according to the method discussed above with reference to pedal assembly 8 (see FIG. 2-1) move the table 6 widely by replacing the movable support 7, however, under such condition the corresponding set hole 413 of the set plate 41 should be fixed with a set bolt a4, in order to limit the oscillation magnitude of the leg lift attachment 9 within the set plate 41(see FIG. 3-1). Besides, the invented gym exerciser can according to the method as indicated in FIG. 2-2 to make the rest seat 62 inclined upwards by means of the replacement of the supporting stand 63; the user can lie on the rest seat 62 and carry out the leg lift movement (see FIG. 3-2). Furthermore, with the help of the sit up support 91, the user can lie either horizontally or upside down subject to the adjustment of the seat 6 to carry out the sit up movement.

A further preferred embodiment of the present invention will be that to provide a set of rollers 53 at the front edge of the base 5 of the gym exerciser (see FIG. 1) for more convenient transportation, and to provide a vertically movable foot support 512 on the support 511 of the supporting stand 51, so that after sit up exercises the user can hook the foot support 512 with his legs to form a force point for energy saving stand up.

I claim:

1. A multi-functional gym exerciser comprising:

a base assembly including a longitudinally extending base member having a front end portion, a rear end portion and a plurality of longitudinally spaced holes formed therein between said front and rear end portions, and a substantially upright support stand member fixedly secured at a lower end thereof to the front end portion of said base member;

a plurality of rollers attached to one of said front and rear end portions of said base member, said plurality of rollers being adapted to engage a ground surface upon tilting of said base assembly in order to aid in moving said multi-function gym exerciser;

a main body assembly including a longitudinally extending main body member having first and second ends, said main body member including at least one semi-circular set plate at the first end thereof, said set plate including a plurality of spaced limiting holes extending therethrough about a substantial portion of its periphery;

means for pivotally mounting said main body member, adjacent the first end thereof, to an upper end of said support stand member;

a movable support member having an upper end pivotally mounted to said main body member adjacent the second end of said main body member and a lower end;

means for selectively securing the lower end of said movable support member to said base member at any one of said plurality of longitudinally spaced holes formed in said base member so as to adjust the position of said main body member relative to said base assembly;

at least one exercise attachment;

means for pivotally attaching said at least one exercise attachment to said set plate at a point radially inwardly spaced from the periphery of said set plate; and means for selectively securing said at least one exercise attachment against pivotal movement with respect to said set plate, said selective securing means including a setting member adapted to extend through one of said plurality of spaced limiting holes and engage said pivotal attaching means to secure said pivotal attaching means to said set plate.

2. A multi-functional gym exerciser as claimed in claim 1, wherein said at least one exercise attachment comprises at least one of a pedal assembly and a leg lift assembly.

3. A multi-functional gym exerciser as claimed claim 1, wherein said base assembly further comprises an additional support extending diagonally between said support stand member and said base member.

4. A multi-functional gym exerciser as claimed claim 3, further comprising a foot support secured to said base assembly.

5. A multi-functional gym exerciser as claimed claim 1, further comprising a sit-up support bar secured to said main body member between said first and second ends thereof.

6. A multi-functional gym exerciser as claimed claim 1, further comprising a rest seat assembly adjustably secured to said main body member.

7. A multi-functional gym exerciser as claimed claim 6, further comprising a seat secured to said main body member forward of said rest seat.

* * * * *